US008333593B2

(12) United States Patent
Nicol

(10) Patent No.: US 8,333,593 B2
(45) Date of Patent: Dec. 18, 2012

(54) DEVICE, SYSTEM AND GAME TO PLAN MEALS AND SNACKS

(76) Inventor: Jean Nicol, New Glasgow (CA)

( * ) Notice: Subject to any disclaimer, the term of this patent is extended or adjusted under 35 U.S.C. 154(b) by 0 days.

(21) Appl. No.: 12/008,580

(22) Filed: Jan. 11, 2008

(65) Prior Publication Data

US 2009/0136904 A1 May 28, 2009

(30) Foreign Application Priority Data

Nov. 23, 2007 (CA) ..... 2612218

(51) Int. Cl.
*G09B 19/00* (2006.01)

(52) U.S. Cl. ..... 434/127

(58) Field of Classification Search ..... 434/127; 128/921

See application file for complete search history.

(56) References Cited

U.S. PATENT DOCUMENTS 2,314,387 A * 3/1943 Carlsson ..... 434/127
4,652,241 A * 3/1987 McCarty ..... 434/127
4,832,603 A * 5/1989 Basil ..... 434/127
4,976,622 A * 12/1990 Clark ..... 434/127
5,044,958 A * 9/1991 Robertson et al. ..... 434/127
5,338,202 A * 8/1994 Saari ..... 434/127
5,832,446 A * 11/1998 Neuhaus ..... 705/1
7,753,681 B2 * 7/2010 Smith et al. ..... 434/127
2003/0129570 A1 * 7/2003 Alabaster ..... 434/127

OTHER PUBLICATIONS

Designer's Ink. An Instructional Aid on Indulin-Dependent Diabetes Mellitus. retrieved on Jan. 21, 2004. http://web.archive.org/web/20040121021024/http://designersink.com/Diabetes/mealplan.htm.*

* cited by examiner

*Primary Examiner* — Kesha Y. Frisby
(74) *Attorney, Agent, or Firm* — Frank J. Bonini, Jr.; John F. A. Earley, III; Harding, Earley, Follmer & Frailey, P.C.

(57) ABSTRACT

A device to plan meals, comprising, at least one Food Item Piece corresponding to an item of food, at least one Food Item Storage Page adapted to temporarily store the at least one Food Item Piece and at least one Daily Meal Planning Chart adapted to temporarily store the at least one Food Item Piece, wherein an individual may plan a meal by selecting at least one Food Item Piece corresponding to an item of food from the at least one Food Item Storage Page and temporarily store it on the at least one Daily Meal Planning Chart.

1 Claim, 6 Drawing Sheets

DEVICE, SYSTEM AND GAME TO PLAN MEALS AND SNACKS

FIELD OF THE INVENTION

The present invention relates to a device, system and game to plan meals and snacks, and more particularly, relates to a device, system and game to plan meals and snacks to improve an individual's diet and eating habits.

BACKGROUND OF THE INVENTION

Having a healthy and balanced diet and making sound nutritional choices is an important part of healthy living, and is desirable for everyone, including individuals who have limited reading and writing and communication capabilities, individuals having disabilities such as autism and other disabilities that may impede one's ability to make and communicate choices, and individuals who may otherwise need to, or would benefit from an improved healthy and balanced diet.

While many efforts have been made to provide general knowledge as to the importance of having a healthy and balanced diet and making sound nutritional choices, it is desirable to have a comprehensive, easy to use, enjoyable to use, easy to understand device and system to assist individuals in planning for and achieving a healthy and balanced diet and making sound nutritional choices, including individuals having very limited verbal and/or literacy skills. It is also desirable to provide a visual device and system to assist and enable individuals, including individuals with autism and other communication impairments for the purposes of allowing them to make good meal choices, to increase their control over their environment, and to improve mealtime predictability.

SUMMARY OF THE INVENTION

Accordingly, one object of the present invention is to provide a device and system to assist individuals in planning for and achieving a healthy and balanced diet and making sound nutritional choices.

Accordingly, another object of the present invention is to provide a comprehensive device and system that is easy to use, enjoyable to use, and easy to understand for planning for and achieving a healthy and balanced diet and making sound nutritional choices.

Accordingly, another object of the present invention is to provide a visual device and system to assist and enable individuals, including individuals with autism and other communication impairments for the purposes of allowing them to make good meal choices, to increase their control over their environment, and to improve mealtime predictability.

According to one aspect of the present invention, there is provided a device to plan meals, comprising, at least one Food Item Piece corresponding to an item of food, at least one Food Item Storage Page adapted to temporarily store the at least one Food Item Piece and at least one Daily Meal Planning Chart adapted to temporarily store the at least one Food Item Piece, wherein an individual may plan a meal by selecting at least one Food Item Piece corresponding to an item of food from the at least one Food Item Storage Page and temporarily store it on the at least one Daily Meal Planning Chart.

The advantage of the present invention is that it provides a device and system to assist individuals in planning for and achieving a healthy and balanced diet and making sound nutritional choices.

Another advantage of the present invention is that it provides a comprehensive device and system that is easy to use, enjoyable to use, and easy to understand for planning for and achieving a healthy and balanced diet and making sound nutritional choices.

Another advantage of the present invention is that it provides a visual device and system to assist and enable individuals, including individuals with autism and other communication impairments for the purposes of allowing them to make good meal choices, to increase their control over their environment, and to improve mealtime predictability.

BRIEF DESCRIPTION OF THE DRAWINGS

A preferred embodiment of the present invention is described below with reference to the accompanying drawings, in which.

DESCRIPTION OF THE PREFERRED EMBODIMENT

Figure 1:
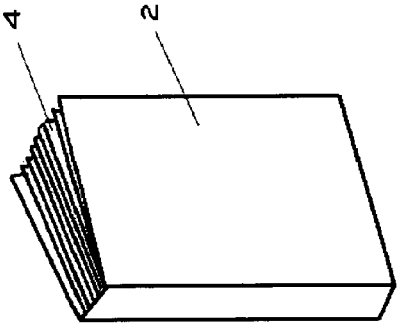
FIG. 1 is a binder in which the device of one embodiment of the present invention may be presented and available for use.
Figure 2:
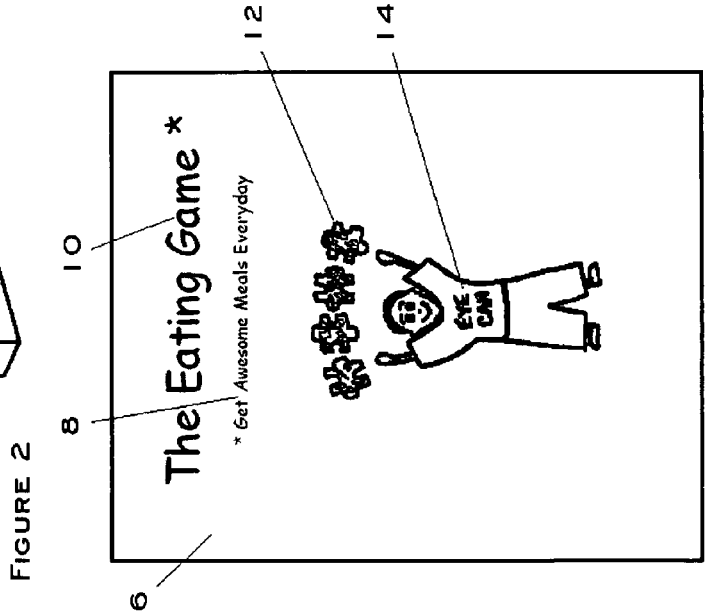
FIG. 2 is a typical title page of one embodiment of the present invention presented on or within the binder in one embodiment of the present invention.
Figure 7:
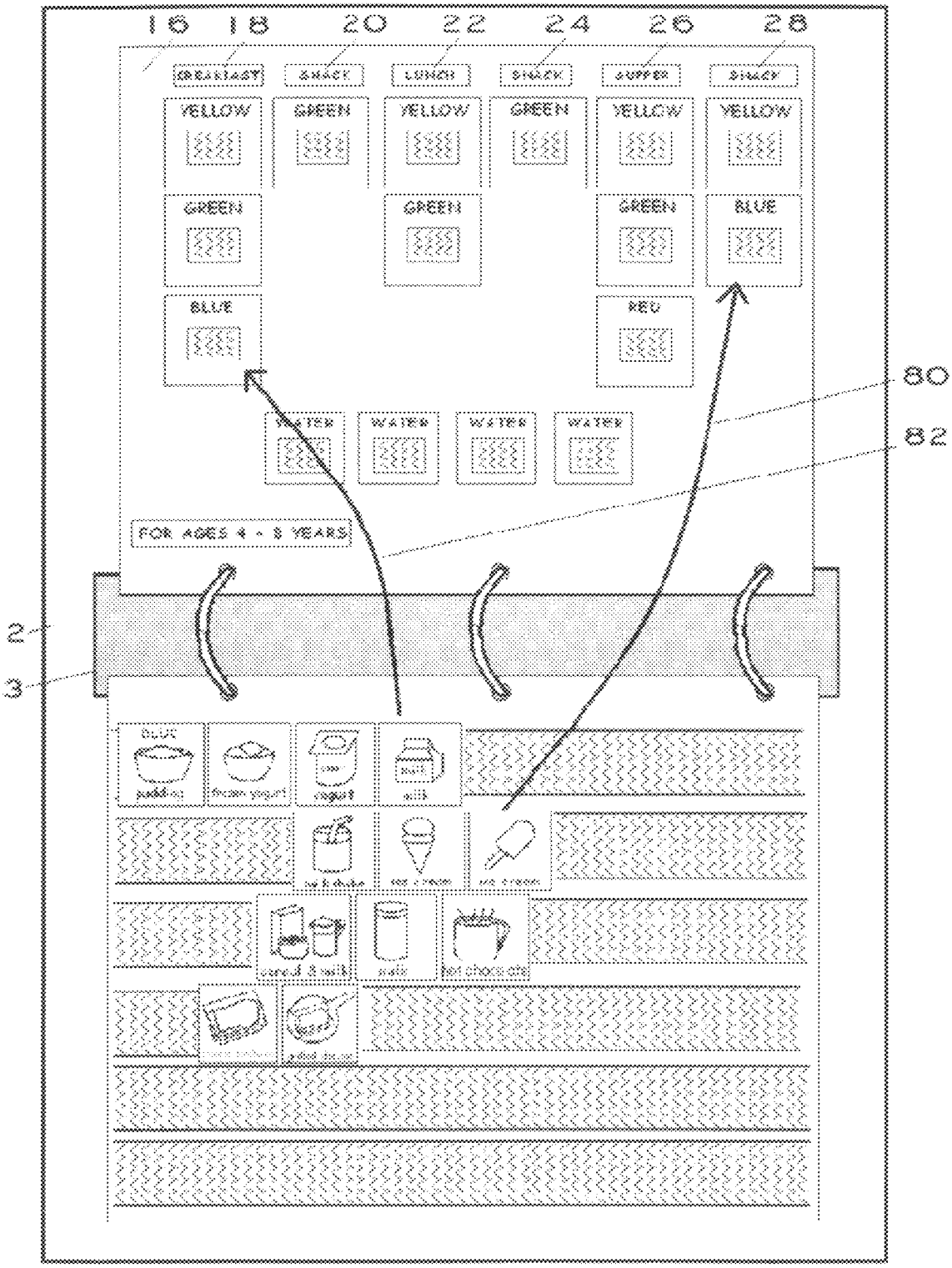
FIG. 7 illustrates, in one embodiment of the present invention, the transfer of Food Item Pieces from the Food Item Storage Page of one embodiment of the present invention to a Daily Meal Planning Chart of one embodiment of the present invention.

In a preferred embodiment of the present invention, as illustrated in FIGS. 1 and 7, preferably a binder 2, for example, a three ring 3 binder, is provided (it being understood that in alternative embodiments of the present invention, alternative devices may be used to store and present the Food Item Pieces, Food Item Storage Pages, Daily Meal Planning Charts, and other pages, sheets, and data utilized in the present invention as would be known to a person skilled in the art, all of which are hereinafter referred to as a "binder" unless otherwise indicated), the binder 2 being preferably made of semi-transparent vinyl which can be easily kept and cleaned as required, into which binder 2 preferably multiple pages 4 including Food Item Storage Pages and Daily Meal Planning Charts and other sheets are placed as hereinafter described, the pages have appropriately positioned holes 48 therein to permit the pages to be placed in the binder in a manner known to a person skilled in the art. In the preferred embodiment of the present invention, as illustrated in FIG. 2 a title page or binder cover page 6 is provided, either for insertion into the binder 2 of the preferred embodiment of the present invention, or otherwise securely fastened to the exterior cover of the binder 2 of the preferred embodiment of the present invention in a manner known to a person skilled in the art. In one embodiment of the title page of the present invention, a variety of indica are provided, including, for example, a title, for example, "The Eating Game" 10 (the word GAME being for example, an acronym for the phrase "Get Awesome Meals Everyday" 8), along with, for example, the image of a friendly individual 14 and several jigsaw puzzle pieces 12, it being understood that a wide variety of different indicia and written material may be presented on the title or cover page 6 as would be understood by a person skilled in the art.

Figure 3A:
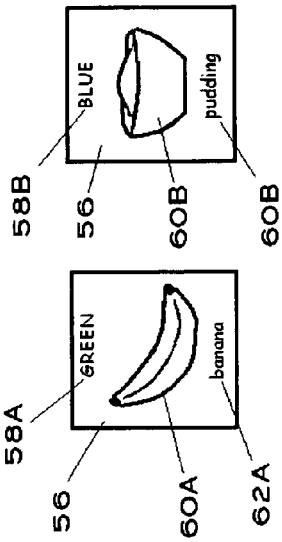
FIG. 3A illustrates two Food Item Pieces of one embodiment of the present invention.

In the preferred embodiment of the present invention, as illustrated in FIGS. 3A, 3B, 4, 5, 6, and 7 Food Item Pieces 56 are provided (in the preferred embodiment of the present invention, more than 200 Food Item Pieces are provided, it being understood that a wide range and number of Food Item Pieces are possible), which in a preferred embodiment are made from laminated card stock paper, and as more fully illustrated in the samples shown in FIG. 3A, each of which preferably presents a pictorial representation of a food or beverage item (for example, a pictorial representation of a banana 60A and a bowl of pudding 60B), along with the printed or written name of the food or beverage item ("banana" 62A and "pudding" 62B respectively), and in one embodiment of the present invention, the color of the card stock paper for each of the Food Item Pieces in a food group corresponding to a color-coding scheme for that food group (each food group having a unique color assigned to it, and all of the food or beverage items in any particular food group having that unique color displayed or otherwise associated with the Food Item Pieces for those food or beverage items in that food group, as more fully described herein). In another embodiment of the present invention, the color of the food group to which a food or beverage item belongs is displayed on the Food Item Piece for that food or beverage item, the color being for example, displayed as a background color, and/or as a colored label and/or by printing or writing the name of the color on the Food Item Piece (for example, "Green" 58A and "Blue" 58B, as illustrated in FIG. 3A), and in one embodiment of the present invention, to assist visually impaired individuals, the name of the color may be provided in Braille format on the Food Item Piece.

In a preferred embodiment of the present invention, the color for each Food Item Piece is selected according to the classification scheme of, for example, Canada's Food Guide, by which food and beverage items are classified in groups, each of the four classification groups being assigned a unique color (so for example, the color "green" is assigned to the Canada Food Guide group that includes vegetables and fruits, so that in the context of one embodiment of the present invention, all of the Food Item Pieces of each of the food and beverage items in that particular group or classification have a common color "green" (that color may be used, for example, as the Food Item Pieces' background or paper color, and/or as a colored label and/or by printing or writing the name of the color on the Food Item Piece). It is understood that while the present invention has been described with reference to the color classification and food grouping scheme of Canada's Food Guide, in alternative embodiments of the present invention, alternative color classification and food grouping schemes may be utilized in a manner known to a person skilled in the art.

In the preferred embodiment of the present invention, one or more appropriately color coded Food Item Pieces are provided for each of the typical food and beverage items that may be included in individual's diet, including for example most standard food and beverage items, and where appropriate, any additional locally available food and beverage items.

Figure 3C:
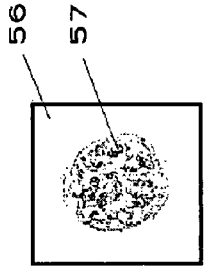
FIG. 3C illustrates a view from the rear of a Food Item Piece of the embodiment of the present invention.
Figure 5:
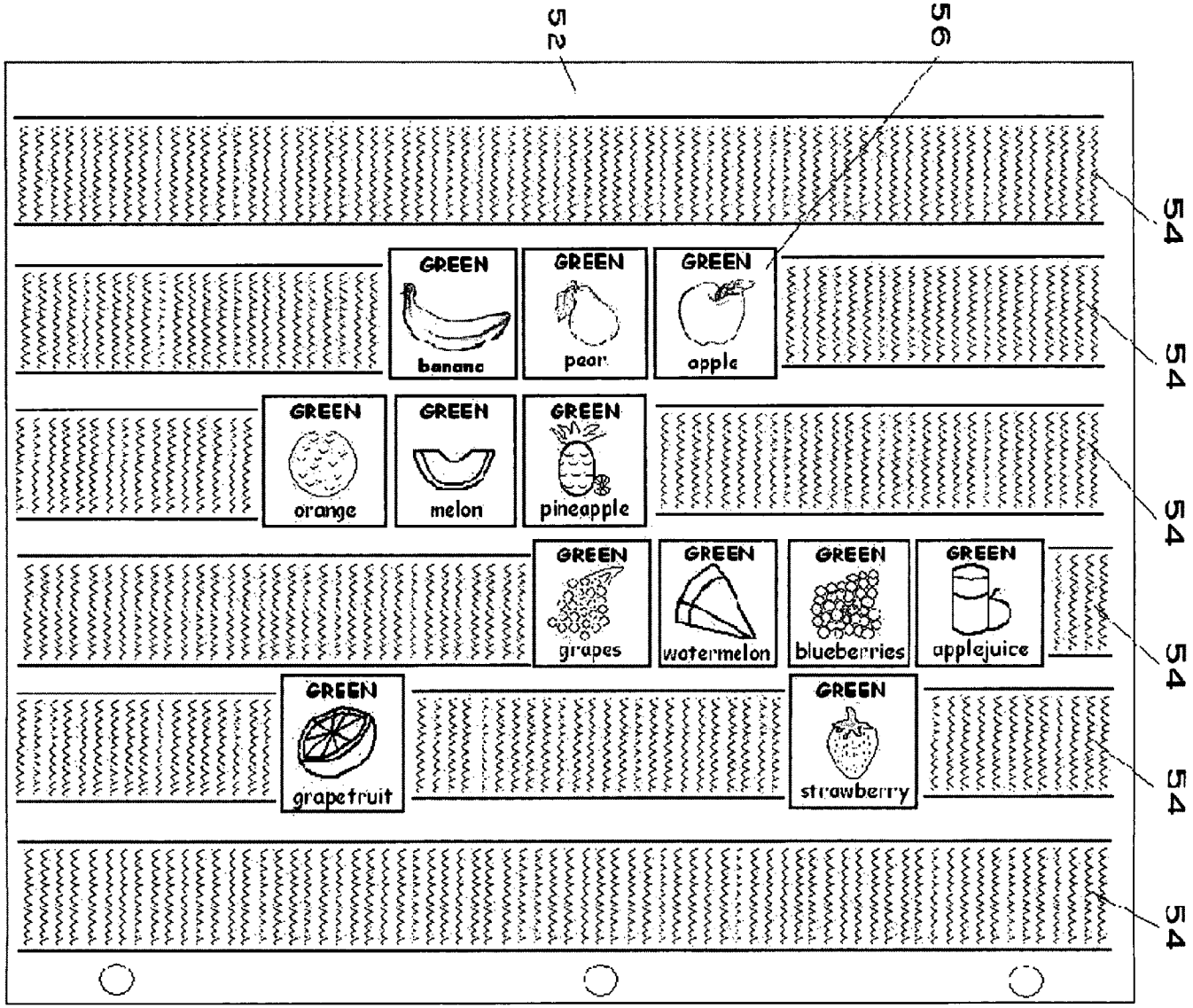
FIG. 5 illustrates one embodiment of a Food Item Storage Page of the present invention.
Figure 6:
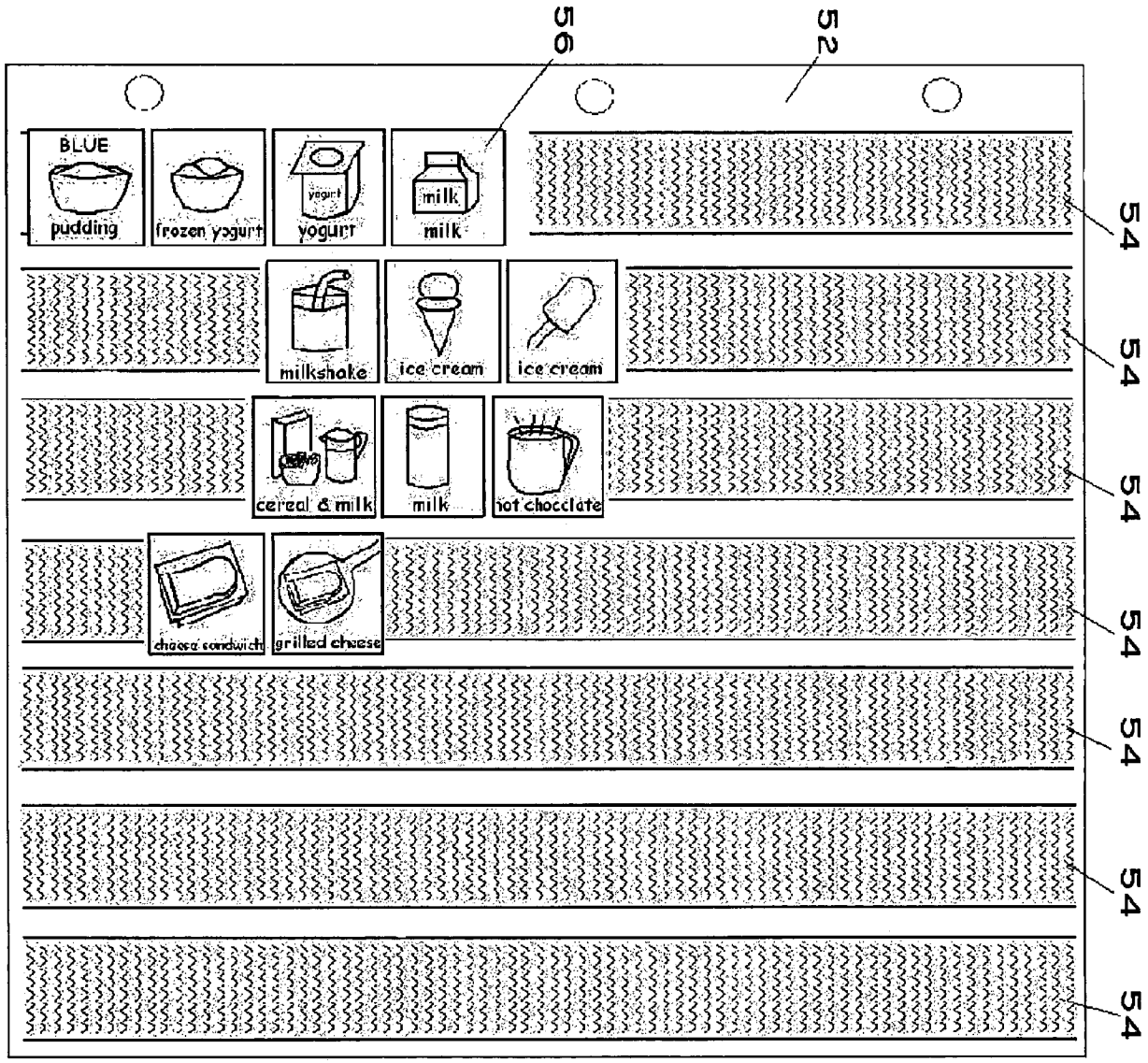
FIG. 6 illustrates another embodiment of a Food Item Storage Page of the present invention.

In one embodiment of the present invention, as illustrated in FIGS. 5 and 6, one or more Food Item Storage Pages are provided, which are adapted to securely and temporarily receive thereon one or more Food Item Pieces, for example, by way of a hook and fastener system, such as, for example, a Velcro-type hook and fastener system (each of the Food Item Pieces having, for example, securely fastened to the back surface thereof as illustrated in FIG. 3C, a hook and fastener system, for example, a short piece of Velcro-type hook and fastener material 57 with the hook surface exposed rearwardly and adapted for engagement with one of the lengths of hook and fastener Velcro-type tape 54 with the loop surface exposed outwardly, which have been securely fastened to the surface of the Food Item Storage Pages (it being understood that in alternative embodiment, the hook and fastener Velcro-type tape on the Food Item Pieces exposes rearwardly a loop surface, and the lengths of hook and fastener Velcro-type tape 54 exposes a hook surface, it also being understood that in alternative embodiments of the present invention, a wide variety of different attachment mechanisms may be utilized to temporarily and securely fasten the Food Item Pieces 56 to the Food Item Storage Pages as would be known to a person skilled in the art, including, for example, tape, magnets (to a magnetically attractive surface), snaps, pushpins (for use in the context of, for example, a bulletin board), thumbtacks (for use in the context of, for example, a bulletin board), paper clips, pouches or pockets, hook and eye fasteners, nail and loop fasteners, adhesive putty, dual lock polyolefin reclosable fasteners, spray adhesives, glue dots, reusable adhesive sheets & strips and such other attachment devices as are known to a person skilled in the art).

In the preferred embodiment of the present invention, each Food Item Storage Page is associated with a food group, so that, for example, one Food Item Storage Page may be utilized to store thereon, Food Item Pieces representative of food and beverage items in the "milk products" group and another Food Item Storage Page may be utilized to store thereon, Food Item Pieces representative of the food and beverage items in the "bread, grain and cereal" group (it being understood that in some cases, more than one Food Item Storage Page may be utilized to store all of the Food Item Pieces in a particular food and beverage group, it also being understood that in some cases, more than one food and beverage group may be stored on a single Food Item Storage Page).

In a preferred embodiment of the present invention, all of the Food Item Storage Pages are stored within the binder, and preferably, in the case where more than one Food Item Storage Page is utilized to store the Food Item Pieces in a particular group, those Food Item Storage Pages are stored adjacent to one another in the binder. In this way, the individual using the device and system of the present invention may readily locate Food Item Storage Pages and the Food Item Pieces associated with the food item of interest to the individual.

Figure 3B:
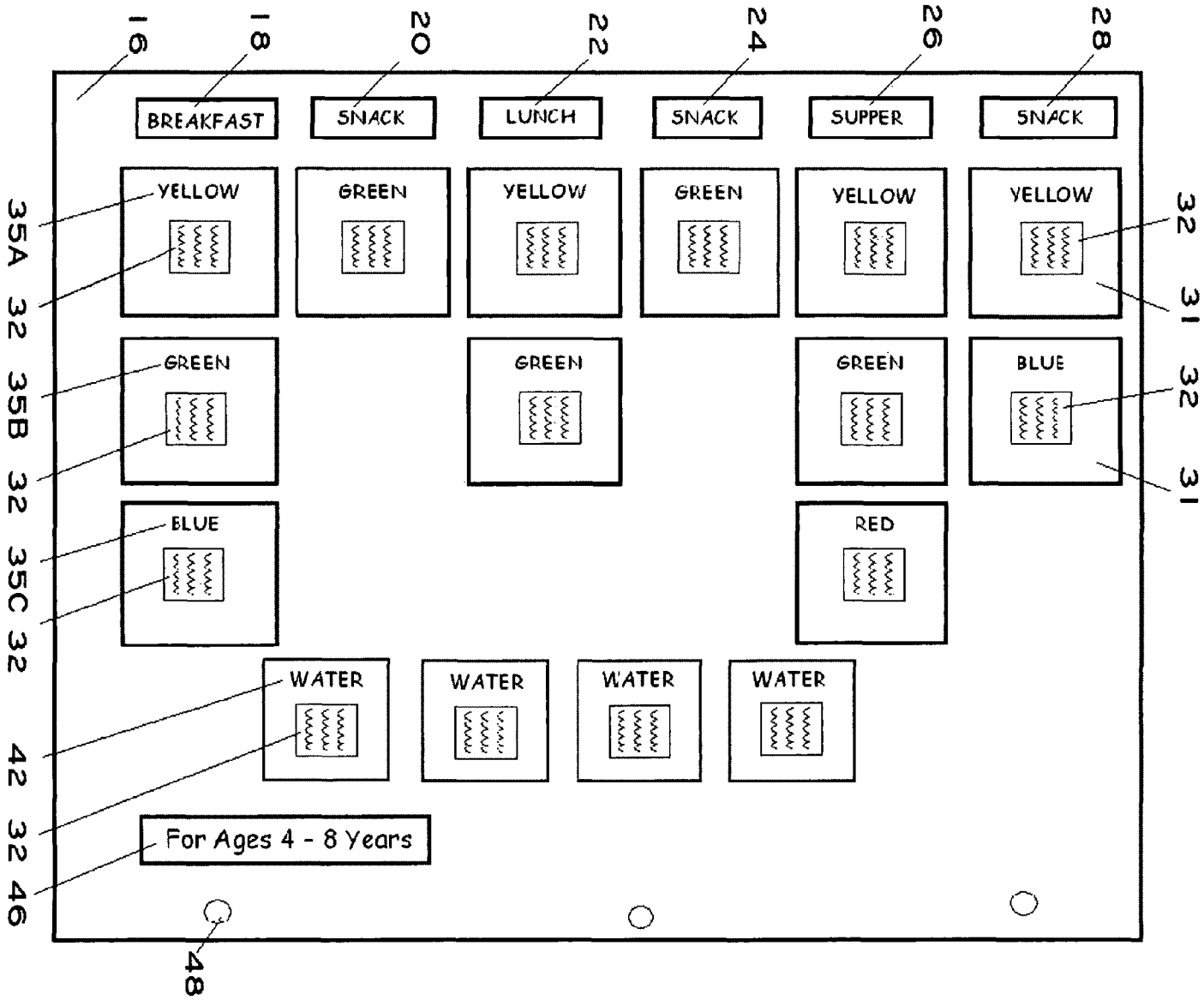
FIG. 3B illustrates a Daily Meal Planning Chart of one embodiment of the present invention for use by individuals aged four through eight.
Figure 4:
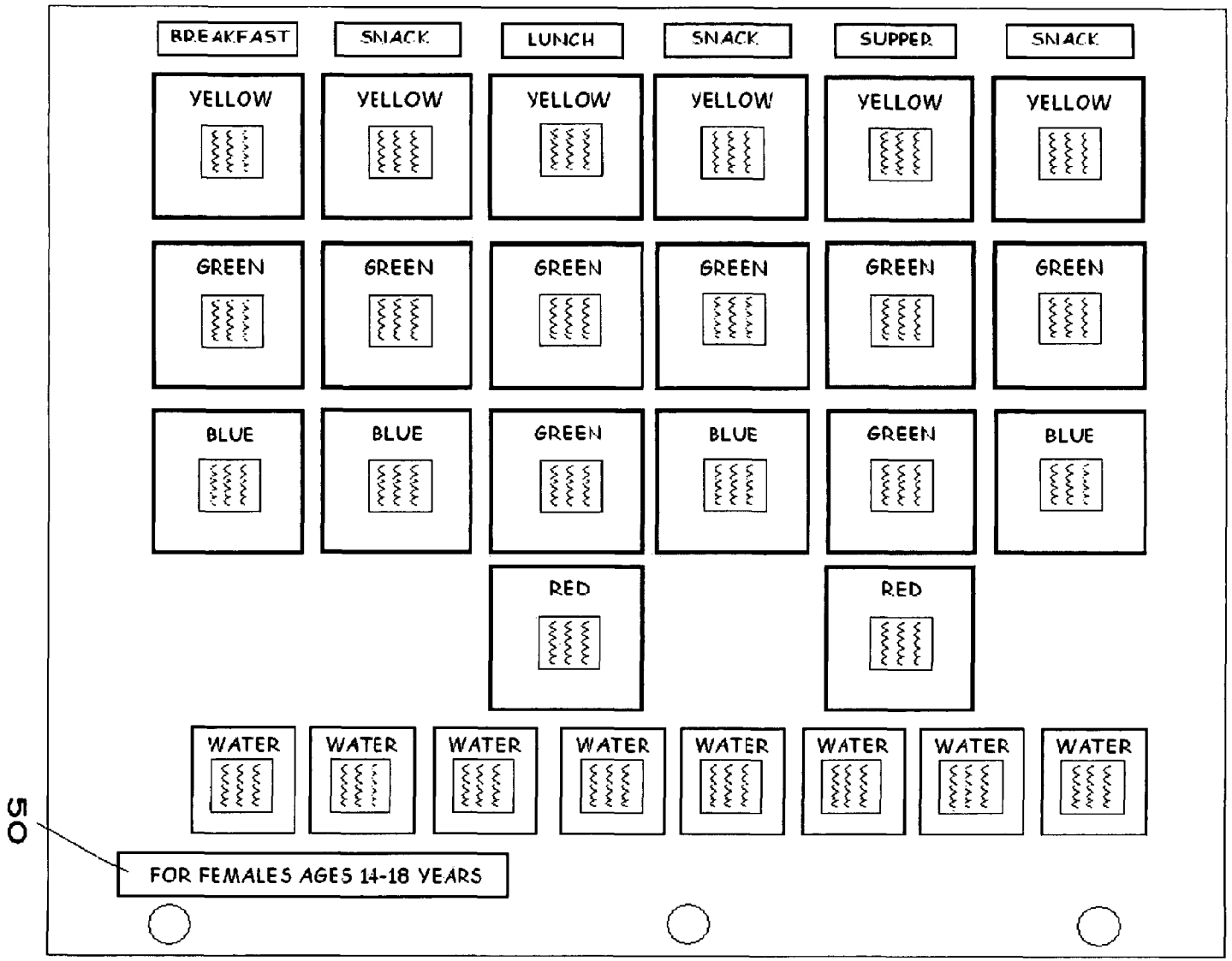
FIG. 4 illustrates another embodiment of a Daily Meal Planning Chart of the present invention for use by females aged fourteen through eighteen.

In one embodiment of the present invention, as illustrated in FIGS. 3B and 4, one or more Daily Meal Planning Charts are provided and inserted into the binder 2, the Daily Meal Planning Charts preferably being presented on laminated white card stock paper 16, upon which is preferably printed or otherwise presented, meal and/or snack names, for example as illustrated in FIG. 3, the meal and/or snack names "Breakfast" 18, "Snack" 20, "Lunch" 22, "Snack" 24, "Supper" 26, and "Snack" 28, beneath which may be presented a column of color-coded attachment labels 31 (more fully described herein) to which Food Item Pieces (more fully described herein) may be affixed to the Daily Meal Planning Charts, for example by way of a hook and loop fastener system, such as a Velcro®-type hook and loop fastener system or other fastener system 32 adapted to temporarily engage the Food Item Piece to the Daily Meal Planning Charts at the attachment label 31 locations thereon, beneath the corresponding meal and/or snack names, the number and color-coding of the attachment labels 31 associated with each meal or snack corresponding to the recommended number of portions of each of the different food groups to be planned for that meal or snack (the attachment labels either being colored coded by visually presenting that color at or proximate the label location or by printing the name of the color at or proximate the label location, or both). For example, if the Canada Food Guide is being used to determine the food groupings and recommended portions, for breakfast meals for females aged 14 through 18 for which FIG. 4 illustrates a typical Daily Meal Planning Charts as indicated by the label 50 displayed on that Daily Meal Planning Chart, a single yellow attachment label 35A (yellow being Canada Food Guide's selected color to represent food and beverages in the "bread, grain and cereal" group), a single green attachment label 35B (green being Canada Food Guide's selected color to represent food and beverages in the "vegetables and fruit" group) and a single blue attachment label 35C (blue being Canada Food Guide's selected color to represent food and beverages in the "milk products" group) is provided beneath the "Breakfast" heading to indicate that the meal plan proposed by the Daily Meal Planning Chart recommends a single portion from each of these groups is to be consumed at breakfast by females aged 14 through 18, as previously referenced, the Food Item Pieces being similarly coded to correspond to this color coding classification scheme. It is understood that in alternative embodiments of the present invention, the snack and meal arrangements and the attachment labels presented on the Daily Meal Planning Chart may be varied in accordance with the desire of the individual.

As illustrated in FIGS. 3B and 4, different Daily Meal Planning Charts may be provided for use by different gender and age groups, preferably as so indicated by labels 50 provided thereon (for example, as ranges of ages for each gender may be the subject of their own unique Daily Meal Planning Chart corresponding to the unique dietary needs of that group), the number and food group type attachment labels (and corresponding color coding) for each of the different gender and age groups being varied as needed to ensure that each individual's diet in that group is balanced and healthy (and in the preferred embodiment of the present invention, in accordance with the Canada Food Guide for that individual's age and gender).

While the present invention has been described with reference to the Food Item Pieces being attached to the Daily Meal Planning Chart beneath the corresponding meal and/or snack names, it is understood that other arrangements of the Food Item Pieces may be utilized relative to the Daily Meal Planning Chart as would be known to a person skilled in the art.

To use the device and system of the present invention, the Food Item Pieces are stored, according to color (food group type) on the corresponding and appropriate Food Item Storage Pages. Thereafter, when the individual wishes to plan a meal or snack (or wishes to plan the meals and snacks for a particular day or for a set of days), the individual chooses the age-gender-appropriate Daily Meal Planning Chart and for each attachment label for each meal or snack on that Daily Meal Planning Charts to be planned, locates from the appropriate Food Item Storage Pages (using the color coding system described herein, the pictorial representation of the desired food item and/or the printed description of the food item corresponding to the color coding of the attachment locations on the Daily Meal Planning Chart for that/those meal(s) or snack(s)) a Food Item Piece having a color match corresponding to the color of the corresponding attachment label, gently removes the Food Item Piece from the Food Item Storage Page and fastens the Food Item Piece to that attachment label on the Daily-Meal Planning Chart and repeats this process until all of the attachment labels on that Daily Meal Planning Chart for that/those meal(s) or snack(s) are covered by Food Item Pieces, the individual ensuring that each of the Food Item Pieces is color matched to its attachment label. For example, as illustrated in FIG. 7, when planning a particular day represented by the Daily Meal Planning Chart illustrated in FIG. 7, the individual, to complete or cover the two "blue" attachment labels 38 and 39 located beneath the "Breakfast" and "Snack" headings respectively, selects from the "blue" Food Item Storage Page upon which the Food Item Pieces for "milk" and "ice cream" are temporarily stored (in the preferred embodiment, they are both stored on the "blue" Food Item Storage Page for "milk products", to which group, the Canada Food Guide has assigned the color "blue" which designation is also utilized in the preferred embodiment of the present invention). Thereafter, the Food Item Pieces corresponding to "milk" and "ice cream" are repositioned (as illustrated by the arrows 80 and 82) by the individual and temporarily fastened to appropriate "blue" attachment labels 38 and 39 on the Daily Meal Planning Chart beneath the "Breakfast" and "Snack" headings on the Daily Meal Planning Chart. This process is repeated until the individual has completed (filled or covered) each of the attachment labels with a colored-matched Food Item Piece in each of the meal and snack columns for each meal and snack to be planned. At the conclusion of each day, or at such other convenient time, the Food Item Pieces may be removed from the Daily Meal Planning Chart for that day and returned to their appropriate and respective Food Item Storage Pages for future reuse as needed.

While some food characterization schemes (including Canada's Food Guide) do not make specific reference to the number of servings of water to be consumed each day, in one embodiment of the present invention, one or more attachment labels for water 42 may also be provided, as illustrated in FIGS. 3B and 4 (and in one embodiment of the present invention, an appropriate, unique and consistent color coding scheme being used for the "water" Food Item Pieces and attachment labels).

In use, it is understood that the present invention is not only user friendly, but also provides individuals with a choice as to distinguishing between food items based upon the printed name of the food item, the pictorial representation of the food item, and, by way of the color coding system utilized thereon, providing additional assistance to the individual in correctly grouping foods from the same group. Furthermore, with respect to those individuals with limited communication skills, it provides those individuals with an opportunity either to manipulate the Food Item Pieces themselves, or alternatively, to direct or point to an assistant to manipulate the Food Item Pieces on their behalf.

The present invention has been described herein with regard to preferred embodiments. However, it will be obvious to persons skilled in the art that a number of variations and modifications can be made without departing from the scope of the invention as described herein.

The embodiments of the invention in which an exclusive property or privilege is claimed are defined as follows:

1. A device for use by a person to create at least one meal plan and to display a visual representation of an item of food relating to the at least one meal plan, comprising:

a. at least one Food Item Piece corresponding to the item of food, wherein the at least one Food Item Piece displays thereon a visual representation of the item of food; and b. at least one Meal Planning Chart including a fastening system for releasably engaging the at least one Food Item Piece and to present the visual representation of the food item displayed thereon to serve as the selection of the meal, said fastening system consisting of a fastening element selected from the group consisting of hook and fastener tape, tape, magnet to a magnetically attractive surface, snap, pushpin, thumbtack, paper clip, pouch, pocket, hook and eye fastener, nail and loop fastener, adhesive putty, dual lock polyolefin reclosable fastener, spray adhesive, glue dot, reusable adhesive sheet, and reusable adhesive strip;

wherein at least one meal plan is created by the person selecting the at least one Food Item Piece corresponding to the item of food and releasably engaging it with the at least one Meal Planning Chart with the visual representation of the food item on the at least one Food Item Piece displayed on said Meal Planning Chart;

wherein the Food Item Piece has a first side on which the visual representation is displayed thereon and a second side that contains a fastening element thereon, and wherein the visual representation is displayed when the Food Item Piece is in engagement with the Meal Planning Chart, the visual representation when displayed being the selection, wherein each of the selected Food Item Pieces remains in a visible orientation when placed on said Meal Planning Chart so the visual representation is displayed, so that each Food Item Piece that is selected and applied to the Meal Planning Chart remains visible on the Meal Planning Chart;

wherein visual representations of foods to be chosen for an individual's meal are displayed openly on a Food Item Storage Page that holds Food Item Pieces corresponding with a food group, wherein said Food Item Storage Page releasably engages said Food Item Pieces and outwardly display the visual representation of the food item displayed thereon, wherein said page containing said Food Item Pieces is positionable in adjacent proximity to said Meal Planning Chart being used, said adjacently proximate page having said plurality of Food Item Pieces in releasable engagement stored thereon, wherein said plurality of Food Item Pieces that are openly displayed on said page comprise the selections available for corresponding food items from which to plan a meal on said Meal Planning Chart for a food group, said Food Item Pieces being detachable from engagement with said Food Item Storage Page and attachable on said Meal Planning Chart to represent a selection by the user of an item of food for a meal, and wherein said meal on said Meal Planning Chart represents said user selections and is comprised of Food Item Pieces releasably detached from said Food Item Storage Page;

wherein the at least one Food Item Piece is color coded by food group, and the Meal Planning Chart displays information relating to the at least one meal plan and displays at least one correspondingly color coded location thereon related to the at least one meal plan and related to the food group of the food item to be included in the creation of the at least one meal plan;

wherein the Meal Planning Chart displays meal plans for each meal in a day, the device displaying a visual representation of an item of food relating to a meal plan comprising a plurality of meals for an individual for a day; wherein said meal plan comprises a plurality of meals that are created by the person selecting from said Food Item Storage Page the at least one Food Item Piece corresponding to an item of food and releasably engaging it with the at least one Meal Planning Chart with the visual representation of the food item on the at least one Food Item Piece displayed on said Meal Planning Chart;

wherein said Meal Planning Chart comprises a plurality of attachment labels and an identification of a plurality of meal type names, wherein said attachment labels are associated with a respective meal type name, wherein said attachment labels are provided to have an associated color for each said attachment label, wherein said Food Item Pieces are provided having corresponding colors so that the Food Item Pieces correspond to the colors of said attachment labels, wherein said Food Item Piece color and said associated attachment label color represent a food group, where one color corresponds with one food group; and wherein each color represents a food group and wherein each attachment label is separately identifiable by color to distinguish it from other attachment labels on the Meal Planning Chart that correspond with different food groups;

wherein said meal type name is associated with said plurality of attachment labels and wherein said associated attachment labels that are associated with a meal type name comprise attachment labels that include attachment labels having a plurality of colors to represent colors that correspond with food from different food groups as represented by said Food Item Pieces;

wherein said attachment labels are provided to correspond with one of four colors, and wherein said Food Item Pieces are colored to correspond with one of said four colors, wherein said Meal Planning Chart includes a plurality of meal type names and associated areas, each said associated area corresponding with one of said meal type names and wherein each said associated area is provided on said Meal Planning Chart and contains said attachment labels within said associated area, and wherein said attachment labels in a said associated area comprise attachment labels corresponding with at least a plurality of colors;

wherein all visual representations of foods to be chosen for all of the individual's meals for that day are displayed openly together at the same time on one or more Food Item Storage Pages that hold Food Item Pieces corresponding with a food group, wherein each of said Food Item Pieces are stored together on a Food Item Storage Page by their associated color and group, wherein each said Food Item Storage Page containing said Food Item Pieces is arrangeable adjacent to said Meal Planning Chart being used, each said adjacently arranged page of Food Item Pieces having a plurality of Food Item Pieces in releasable engagement stored thereon, wherein said plurality of Food Item Pieces that are openly displayed on said Food Item Storage Pages containing Food Item Pieces comprise the selections available for items from which plan a meal on said Meal Planning Chart for a food group;

wherein said selections for a group of Food Item Pieces corresponding with a group are contained on multiple Food Item Storage Pages, wherein each said Food Item Storage Page of said multiple Food Item Storage Pages that contain Food Item Pieces is associated with a single group and does not contain Food Item Pieces associated with another group or color.

* * * * *